US009506218B2

(12) United States Patent
Manchester

(10) Patent No.: US 9,506,218 B2
(45) Date of Patent: Nov. 29, 2016

(54) UNDERWATER TRENCHING APPARATUS

(71) Applicant: IHC Engineering Business Limited, Sliedrecht (NL)

(72) Inventor: Jonathan Ralph Manchester, Rowlands Gill (GB)

(73) Assignee: IHC ENGINEERING BUSINESS LIMITED, Sliedrecht (NL)

( * ) Notice: Subject to any disclaimer, the term of this patent is extended or adjusted under 35 U.S.C. 154(b) by 124 days.

(21) Appl. No.: 14/353,101

(22) PCT Filed: Oct. 26, 2012

(86) PCT No.: PCT/GB2012/052665

§ 371 (c)(1),
(2) Date: Apr. 21, 2014

(87) PCT Pub. No.: WO2013/061073

PCT Pub. Date: May 20, 2013

(65) Prior Publication Data

US 2014/0283421 A1 Sep. 25, 2014

(30) Foreign Application Priority Data

Oct. 26, 2011 (GB) ..... 1118496.7

(51) Int. Cl.
*E02F 5/08* (2006.01)
*E02F 5/10* (2006.01)
(Continued)

(52) U.S. Cl.
CPC ..... *E02F 5/104* (2013.01); *E02F 3/9268* (2013.01); *E02F 3/94* (2013.01); *E02F 5/06* (2013.01); *E02F 5/109* (2013.01)

(58) Field of Classification Search
USPC ..... 37/307, 309, 337, 338; 299/39.1, 39.2, 299/39.3; 404/129
IPC ..... E02F 5/04,5/06, 5/08
See application file for complete search history.

(56) References Cited

U.S. PATENT DOCUMENTS 810,810 A * 1/1906 Richardson ..... E02F 5/282 299/17
1,190,257 A * 7/1916 Henderson ..... F41H 11/30 404/126

(Continued)

FOREIGN PATENT DOCUMENTS

FR 2749866 A 12/1997
JE 01-102132 A 4/1989

(Continued)

OTHER PUBLICATIONS

Great Britain Search Report dated Feb. 16, 2012.

(Continued)

*Primary Examiner* — Gary Hartmann
(74) *Attorney, Agent, or Firm* — Troutman Sanders LLP; Ryan A. Schneider

(57) ABSTRACT

An underwater trenching apparatus comprising a soil cutting arrangement having a forwardly disposed cutting portion and a rearwardly disposed non-cutting portion, a soil removal device configured to remove soil from a location forward of the soil cutting arrangement and barrier device located and configured substantially to prevent passage of soil to the non-cutting portion of the soil cutting arrangement. The soil cutting arrangement is typically a rockwheel or chain cutter. The soil removal device is typically a dredge pump or eductor.

19 Claims, 2 Drawing Sheets

(51) Int. Cl.

| | |
|---|---|
| ***E02F 3/92*** | (2006.01) |
| ***E02F 3/94*** | (2006.01) |
| ***E02F 5/06*** | (2006.01) |

(56) References Cited

U.S. PATENT DOCUMENTS

| | | | | | |
|---|---|---|---|---|---|
| 3,554,101 | A * | 1/1971 | Grant | E02D 3/026 | 404/121 |
| 3,572,841 | A * | 3/1971 | Rhodes | B23D 59/02 | 175/313 |
| 4,050,171 | A * | 9/1977 | Teach | E02F 5/145 | 37/308 |
| 4,295,757 | A | 10/1981 | Gaspar | | |
| 4,342,526 | A | 8/1982 | Mousselli | | |
| 4,523,873 | A * | 6/1985 | Elliot | E01C 19/238 | 172/554 |
| 5,575,538 | A * | 11/1996 | Gilbert | E02F 3/20 | 299/39.2 |
| 5,651,200 | A | 7/1997 | Walsh et al. | | |
| 6,055,750 | A * | 5/2000 | Yoder | E02F 3/181 | 37/352 |
| 8,960,808 | B2 * | 2/2015 | Wakita | E02F 3/8866 | 299/39.4 |
| 2002/0017817 | A1 * | 2/2002 | Nakayama | B23D 59/02 | 299/39.3 |
| 2002/0139014 | A1 | 10/2002 | Rivard | | |
| 2009/0236900 | A1 * | 9/2009 | Due | B28D 7/02 | 299/39.3 |

FOREIGN PATENT DOCUMENTS

| | | | |
|---|---|---|---|
| JP | 50-061839 | A | 5/1975 |
| JP | 55-096960 | U1 | 12/1978 |
| JP | 58-072260 | U | 5/1983 |
| JP | 60-078024 | A | 5/1985 |
| JP | 61-075134 | A | 4/1986 |
| JP | 63-047428 | A | 2/1988 |
| JP | 11-100859 | A | 4/1999 |
| JP | 2005-021757 | A | 1/2005 |

OTHER PUBLICATIONS

International Search Report and Written Opinion dated Jan. 9, 2013.
International Preliminary Report on Patentability and Written Opinion of the International Searching Authority for PCT/GB2012/052665 issued on Apr. 29, 2014.
Office Action for related Japanese Patent Application No. 2014-537723 mailed Aug. 16, 2016.

* cited by examiner

UNDERWATER TRENCHING APPARATUS

CROSS-REFERENCE TO RELATED PATENT APPLICATIONS

This application is a United States National Stage Application of, and claims the benefit pursuant to 35 U.S.C. §371 of International Patent Application Serial No. PCT/GB2012/052665, filed on Oct. 26, 2012, which claims priority to and the benefit of Great Britain Application No. 1118496.7, filed on Oct. 26, 2011, both which are incorporated herein in their entirety by reference.

The present invention relates to apparatus or equipment for creating a trench in the bed of a body of water. Such a trench is typically used for burying a cable, pipeline or the like to protect it from damage. The present invention particularly relates to the formation of trenches in hard soils underwater.

BACKGROUND

Numerous devices are known for forming trenches in the bed of a body of water such as a lake or sea. Often, apparatus such as chain cutters and rockwheels are used to cut the trench. Such trench-cutting apparatus cuts through the soil and rock forming the seabed (hereinafter "soil") and tends to produce an amount of spoil in front of the trench cutting apparatus. The build up of such spoil in front of the trench cutting apparatus can cause a number of problems. For example the build up of spoil can stop or inhibit the forward motion of the trench cutting apparatus. Also, soil can be caused to flow around the trench cutting apparatus to backfill the trench before the pipe or cable is laid in the trench. Further, the build up of the soil can cause the soil to interfere with the propulsion mechanism (for example articulated vehicle tracks) of the soil cutting apparatus.

The soils of the seabed tend not to be homogeneous and cobbles and other very hard objects are often encountered by the trench cutting apparatus. Such cobbles can interfere with the operation of the trench cutting apparatus, for example by blocking soil removal devices such as dredge pumps or eductors.

Another, problem is that soil adheres to the cutting components of the trench cutting apparatus (such as the picks of a rockwheel) and causes a blockage which may prevent use of the soil cutting apparatus.

The present invention seeks to overcome or alleviate some or all of these problems.

BRIEF SUMMARY OF THE DISCLOSURE

In accordance with a first aspect of the present invention there is provided an underwater trenching apparatus comprising a soil cutting arrangement having a forwardly disposed cutting portion and a rearwardly disposed non-cutting portion, a soil removal device configured to remove soil from a location forward of the soil cutting arrangement and barrier device located and configured substantially to prevent passage of soil to the non-cutting portion of the soil cutting arrangement.

In preferred embodiments the barrier device is constructed to prevent passage of solid materials contained in the soil having a maximum dimension greater than a selected threshold dimension.

In some preferred embodiments the soil removal device conveys soil in fluidised form.

Preferably the soil removal device is an eductor or a dredge pump.

In some preferred embodiments the barrier device is configured to prevent or deter entry of solid materials to an inlet of the eductor or dredge pump, where such solid materials have a dimension greater than a selected threshold dimension.

In preferred embodiments the soil cutting arrangement includes a plurality of soil cutting elements arranged for movement about an endless path. Particularly preferred soil cutting arrangements include a rockwheel, chain cutter, shearer or the like.

In other preferred arrangements the soil cutting arrangement is an auger.

Preferably the barrier device is disposed substantially at ground level.

Preferably the soil removal device is arranged above the barrier device.

In embodiments wherein the soil removal device is an eductor preferably the eductor driving jet is directed towards the soil cutting arrangement, thereby to displace soil accumulated on the soil cutting arrangement. Preferably the path of liquid exiting the eductor is configured to be substantially tangential to the direction of rotation of the soil cutting arrangement.

In preferred forms the eductor includes a diffuser portion arranged to slow the fluidised flow velocity of the soil conveyed by the eductor, whereby denser material contained within the soil falls back into the trench.

According to a second aspect of the invention there is provided an underwater trenching machine comprising an underwater trenching apparatus as defined in the first aspect of the invention together with means for propelling the machine in a desired direction for trench forming.

Preferably the underwater trenching machine further comprises control means for controlling the operation of the underwater trenching apparatus and/or components thereof.

BRIEF DESCRIPTION OF THE DRAWINGS

For a better understanding of the invention and to show how the same may be carried into effect, reference will now be made, by way of example only, to the following drawings in which.

DETAILED DESCRIPTION

Figure 1:
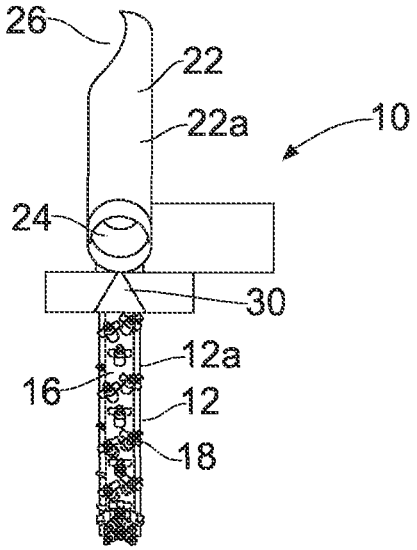
FIG. 1 is a front view of an apparatus according to the invention.
Figure 3:
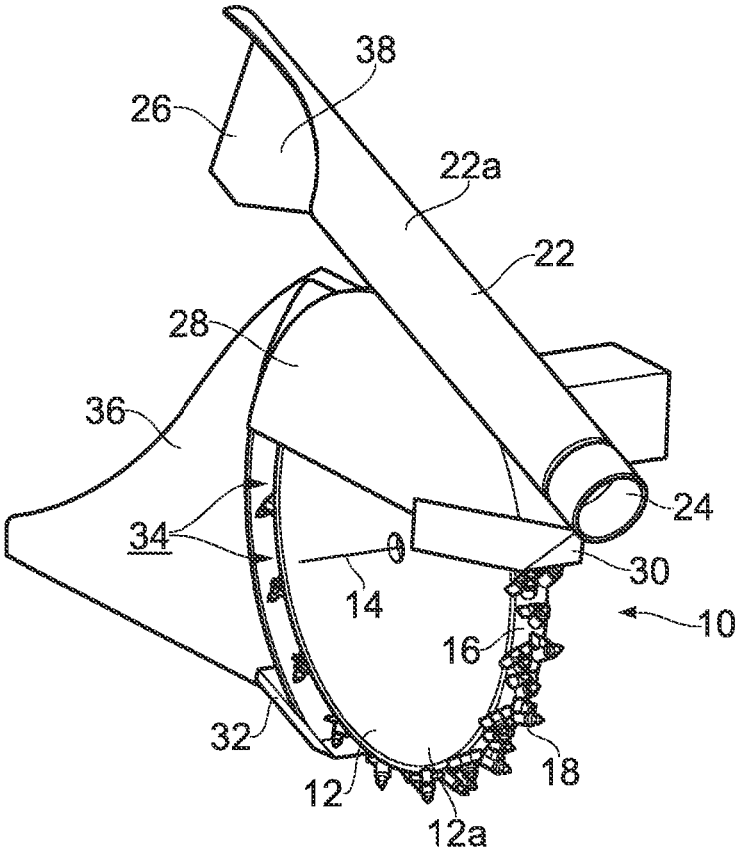
FIG. 3 is a perspective view of the apparatus according to the invention.
Figure 2:
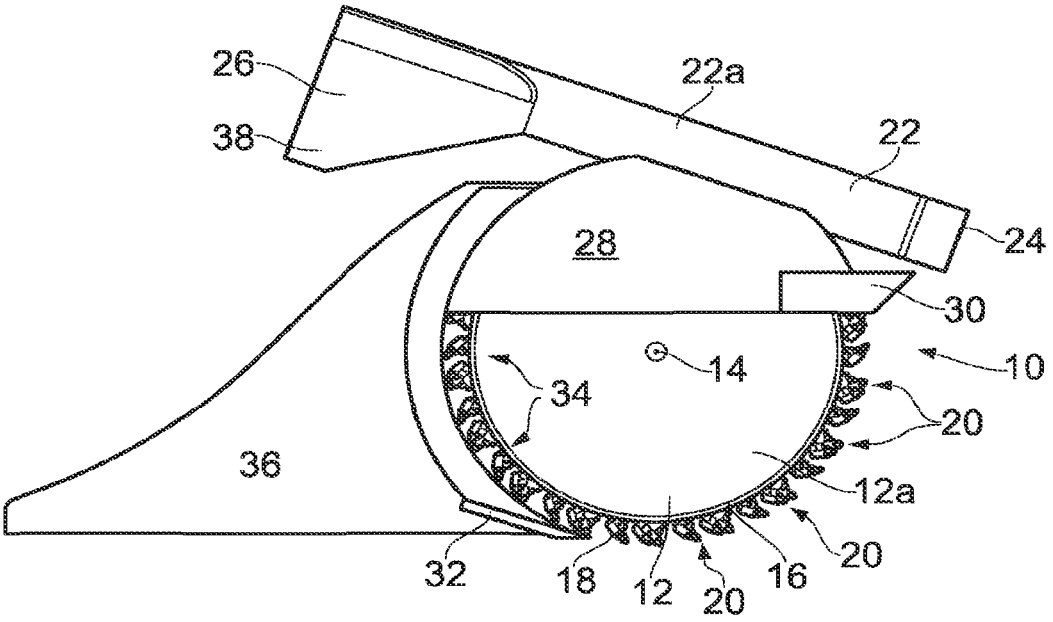
FIG. 2 is a side view of an apparatus according to the invention.

Referring now to the drawings, there is shown an underwater trenching apparatus 10 for forming a trench in the bed of a body of water, for example, the bed of a lake or the seabed. Hereinafter the word "seabed" will be used to refer either to the bed of the lake or the bed of the sea or ocean. The apparatus 10 comprises a soil cutting arrangement 12. Various soil cutting arrangements are known and may be used, preferred examples being chain cutters, rockwheels augers and shearers. In FIGS. 1 to 3, a rockwheel 12*a* is shown. The rockwheel 12*a* comprises a wheel or disc mounted for rotation about a nominally horizontal axis 14. The rockwheel 12*a* has an outer circumferential surface 16 to which are mounted a plurality of soil cutting elements 18 which are typically in the form of teeth or picks and are formed from a suitably durable hard material.

The rockwheel 12*a* rotates in an anti clockwise (counter-clockwise) direction with respect to the orientation shown in FIG. 2. Thus, the soil cutting elements 18 traverse an endless circular path around the perimeter of the rockwheel 12*a* and in so doing engage the seabed at a forward potion 20. On engagement with the seabed during their rotation, the soil cutting elements 18 cut into the seabed and displace soil thereby to form a trench.

Chain cutters work in a broadly similar manner to the rockwheel. For chain cutters, the soil cutting elements are mounted on an endless belt or chain which is driven so that the soil cutting elements move in an endless loop and contact the soil during a portion of that movement.

In order to prevent or reduce undesired premature back-filling trench to the rear of the trench cutting apparatus, soil removal means 22 are provided. Various types of soil removal means may be suitable for use with the present invention, but preferred means include dredge pumps and, more especially, eductors. An eductor is illustrated schematically in FIGS. 1 to 3 at 22*a*.

Eductor 22*a* includes an inlet 24 and an outlet 26. Thus, the eductor 22*a* draws soil into the inlet 24 and expels soil via the outlet 26. More specifically, the eductor 22*a* takes up soil from a location forward of the soil cutting arrangement 12 and expels soil typically rearwardly of the soil cutting arrangement 12. In preferred embodiments the eductor 22*a* is constructed so that the path of fluidised material through the eductor is made as straight as possible (and most preferably is perfectly straight). This avoids the build up of soil material at bends within the eductor which could cause a blockage.

The soil cutting arrangement 12 is preferably shrouded at least at its portion which is above ground level during cutting operations. FIGS. 1 to 3 show a shroud or cover 28 which encloses an upper portion of the rockwheel 12*a*. The provision of a shroud or cover 28 increases the efficiency of removal of soil by the soil removal means 22 (preferably the dredge pump or eductor 22*a*).

A particular problem addressed by the present invention is the build up of soil in front of the soil cutting arrangement 12. As noted above such build up of soil can hinder or stop the forward motion of the trenching apparatus 10, can cause soil to flow back around the soil cutting apparatus into the trench and can allow soil to fall into the drive mechanism of the vehicle hindering its motion. Accumulated soil on the soil cutting arrangement 12, in particular on the soil cutting elements (teeth) 18 is also a problem which can reduce the efficiency of the trenching operation. Blockages of the soil removal means 22 can also cause difficulties and delays in the trenching operation. In order to address at least some of these problems, the apparatus 10 of the present invention is further provided with a barrier device 30 or guard which is arranged in front of the soil cutting arrangement 12. The barrier device or guard 30 is preferably arranged immediately in front of the soil cutting arrangement 12. In particular, the barrier device 30 is arranged at least approximately at ground level with respect to the normal ground level at either side of the trench being cut. In some preferred arrangements, the barrier device 30 is adjustable so that its height may be set in accordance with the depth of the trench which is being dug.

The barrier device 30 is constructed so that objects having a dimension greater than a pre-selected size (such as stones or "cobbles") cannot pass the barrier. The pre-selected size is conveniently similar to or the same as the inlet or exhaust pipe diameter of a dredge pump or eductor used for removal of the soil. In preferred arrangements the barrier device is arranged substantially at ground level to prevent excessive amounts of soil being accumulated in front of the barrier device 30.

As can be seen from FIGS. 1 to 3, the soil removal means 22 (typically a dredge pump or eductor 22*a*) is arranged immediately above the barrier device 30.

The barrier device 30 is most preferably constructed from a robust, durable material which can withstand impacts from hard components of the soil. Typically, the barrier device 30 is made from a substantial metal plate, although other suitably strong materials can be used.

In further preferred embodiments, where the soil removal means 22 is an eductor 22*a*, the eductor driving jet can be configured so that it is directed at the soil cutting arrangement 12 (for example the rockwheel 12*a* or a chain cutter). In this way, the soil cutting arrangement 12 is placed in the path of high pressure fluid from the eductor driving jet which is used to displace soil from the soil cutting arrangement 12, in particular to displace soil from around the soil cutting element 18.

A further advantage is achieved if the exit of the eductor 22*a* is substantially tangential to the direction of rotation of the soil cutting arrangement 12 or of the direction of travel of individual soil cutting elements of the soil cutting arrangement 12. In this way, tangential momentum is in the same direction as the fluidised spoil transport method.

In preferred variations of the invention, the apparatus 10 is provided with a crumber unit 32 which assists in preventing re-circulated soil (i.e. soil which has travelled on the soil cutting arrangement 12, passed through the forward portion 20 thereof and to a rearward portion 34) from passing back into the trench. Thus, the crumber 32 assists in providing a trench with a clean bed or bottom portion into which a pipe, cable or the like can be laid. The crumber unit 32 maybe adjustable in height to accommodate different depths of cut of the soil cutting means 12 (that is, of course, different depths of trench). In some arrangements the crumber unit 32 may have a bend restrictor or share 36 mounted to it, for example to provide increased strength and resistance to deformation.

In further preferred arrangements the exit of the dredge pump or eductor can be arranged such that soil can be directed into the trench to the rear of the apparatus 10, after a pipe or cable or the like has been laid. This assists in burying the pipe, cable or the like in the trench.

In further preferred arrangements a diffuser 38 is provided which acts to slow the velocity of the fluidised soil so that denser material falls preferentially back into the trench. The diffuser 38 can be open bottomed to prevent the build up of debris.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. Underwater trenching apparatus comprising:

a soil cutting arrangement having a forwardly disposed cutting portion and a rearwardly disposed non-cutting portion;

a soil removal device configured to remove soil from a location forward of the soil cutting arrangement; and a barrier device located in front of the soil cutting arrangement; and a crumber unit;

wherein the barrier device extends in a travel direction beyond an outer periphery of the forwardly disposed cutting portion, and is configured substantially to prevent passage of soil to the non-cutting portion of the soil cutting arrangement;

wherein the soil removal device comprises an inlet and an outlet, the outlet is provided substantially tangential to the direction of rotation of the soil cutting arrangement or of the travel direction; and wherein the crumber unit is located at the lower part of the rearwardly disposed non-cutting portion to assist preventing re-circulation of the soil.

2. The underwater trenching apparatus as claimed in claim 1, wherein the barrier device is constructed to prevent passage of solid materials contained in the soil having a maximum dimension greater than a selected threshold dimension.

3. The underwater trenching apparatus as claimed in claim 1, wherein the soil removal device conveys soil in fluidized form.

4. The underwater trenching apparatus as claimed in claim 3, wherein the soil removal device is an eductor.

5. The underwater trenching apparatus as claimed in claim 4, wherein the barrier device is configured to prevent or deter entry of solid materials to an inlet of the eductor, where such solid materials have a dimension greater than a selected threshold dimension.

6. The underwater trenching apparatus as claimed in claim 1, wherein the soil cutting arrangement includes a plurality of soil cutting elements arranged for movement about an endless path.

7. The underwater trenching apparatus as claimed in claim 6, wherein the soil cutting arrangement is a rockwheel.

8. The underwater trenching apparatus as claimed in claim 1, wherein the soil cutting arrangement is an auger.

9. The underwater trenching apparatus as claimed in claim 1, wherein the barrier device is disposed substantially at soil level.

10. The underwater trenching apparatus as claimed in claim 1, wherein the soil removal device is arranged above the barrier device.

11. The underwater trenching apparatus as claimed in claim 4, wherein an eductor driving jet is directed towards the soil cutting arrangement, thereby to displace soil accumulated on the soil cutting arrangement.

12. The underwater trenching apparatus as claimed in claim 4, wherein the path of fluid exiting the eductor is configured to be substantially tangential to the direction of rotation of the soil cutting arrangement.

13. The underwater trenching apparatus as claimed in claim 4, wherein the eductor includes a diffuser portion arranged to slow the fluidized flow velocity of the soil conveyed by the eductor, whereby denser material contained within the soil falls back into the trench.

14. The underwater trenching apparatus as claimed in claim 1 further comprising means for propelling the apparatus in a desired direction for trench forming.

15. The underwater trenching apparatus as claimed in claim 14 further comprising control means for controlling the operation of the underwater trenching apparatus.

16. The underwater trenching apparatus as claimed in claim 3, wherein the soil removal device is a dredge pump.

17. Underwater trenching apparatus comprising:

a soil cutting arrangement having a forwardly disposed cutting portion and a rearwardly disposed non-cutting portion;

a soil removal device configured to remove soil from a location forward of the soil cutting arrangement;

a barrier device located in front of the soil cutting arrangement, extending in a travel direction beyond an outer periphery of the forwardly disposed cutting portion, and configured substantially to prevent passage of soil to the non-cutting portion of the soil cutting arrangement;

means for propelling the apparatus in a desired direction for trench forming, wherein the soil removal device comprises an inlet and an outlet, the outlet is provided substantially tangential to the direction of rotation of the soil cutting arrangement or of the travel direction; and a crumber unit located at the lower part of the rearwardly disposed non-cutting portion to assist preventing re-circulation of the soil.

18. The underwater trenching apparatus as claimed in claim 17, wherein the soil cutting arrangement includes a plurality of soil cutting elements arranged for movement about an endless path;

wherein the soil removal device is an eductor that conveys soil in fluidized form;

wherein the barrier device is constructed to prevent passage of solid materials contained in the soil having a maximum dimension greater than a selected threshold dimension; and wherein the barrier device is configured to prevent or deter entry of solid materials to an inlet of the eductor, where such solid materials have a dimension greater than a selected threshold dimension.

19. The underwater trenching apparatus as claimed in claim 18, wherein the soil cutting arrangement is a rockwheel;

wherein the soil removal device is an eductor that conveys soil in fluidized form;

wherein the barrier device is disposed substantially at ground level;

wherein the eductor is arranged above the barrier device;

wherein an eductor driving jet is directed towards the soil cutting arrangement, thereby to displace soil accumulated on the soil cutting arrangement;

wherein the path of fluid exiting the eductor is configured to be substantially tangential to the direction of rotation of the soil cutting arrangement; and wherein the eductor includes a diffuser portion arranged to slow the fluidized flow velocity of the soil conveyed by the eductor, whereby denser material contained within the soil falls back into the trench.

* * * * *